US005582338A

United States Patent [19]

Tamura

[11] Patent Number: 5,582,338

[45] Date of Patent: Dec. 10, 1996

[54] TOOL HOLDER FOR STORING PRUNING AND CUTTING IMPLEMENTS

[76] Inventor: Kazutaka Tamura, 1801 17th Ave., S., Seattle, Wash. 98144

[21] Appl. No.: 436,081

[22] Filed: May 8, 1995

Related U.S. Application Data

[63] Continuation of Ser. No. 171,650, Dec. 22, 1993, abandoned.

[51] Int. Cl.[6] ..... A45F 3/00

[52] U.S. Cl. ..... 224/678; 224/242; 224/268; 224/673; 224/674; 224/677; 224/684; 224/904; 224/907

[58] Field of Search ..... 224/904, 907, 224/268, 253, 252, 232, 234, 225, 224, 226, 227, 242, 673, 674, 677, 678, 684

[56] References Cited

U.S. PATENT DOCUMENTS

| | | | |
|---|---|---|---|
| Des. 258,550 | 3/1981 | Strauss . | |
| Des. 271,253 | 11/1983 | Abatie . | |
| 1,270,158 | 6/1918 | Hill | 224/904 |
| 1,427,849 | 9/1922 | Yder | 224/907 |
| 1,603,861 | 10/1926 | Mundis . | |
| 1,821,258 | 9/1931 | Clark | 224/253 |
| 3,130,883 | 4/1964 | MacKool | 224/253 |
| 4,106,679 | 8/1978 | Hillinger . | |
| 4,307,825 | 12/1981 | Pattermann . | |
| 4,372,468 | 2/1983 | Harvey . | |
| 4,790,461 | 12/1988 | Stover . | |
| 4,932,576 | 6/1990 | Ashley . | |
| 4,986,459 | 1/1991 | Yarbrough, Jr. | 224/904 |
| 5,193,725 | 3/1993 | Radocy | 224/253 |

FOREIGN PATENT DOCUMENTS

| | | | |
|---|---|---|---|
| 171641 | 6/1905 | Germany | 224/268 |
| 343535 | 1/1916 | Germany | 224/234 |

*Primary Examiner*—Linda J. Sholl

*Attorney, Agent, or Firm*—Christensen O'Connor; Johnson & Kindness PLLC

[57] ABSTRACT

In accordance with the present invention, a tool holder 10 is provided for carrying a cutting implement, such as a pair of lopping shears 15, having a plurality of blades 16*a* and 16*b* attached by a pivot 18 to a pair of elongated handles 20*a* and 20*b*. The tool holder includes a support backing 12, containing a plurality of vertically extending slots 34*a* and 34*b*. A waist belt 32 may be passed through the vertically extending slots so that the tool holder may be suspended from the waist belt. A support frame 42 is also attached to the support backing. A rigid cap 14 for housing the blades 16*a* and 16*b* of the lopping shears 15 is fastened to the support frame 42 and the support backing 12. The rigid cap comprises a convex surface having a longitudinal edge 14*a* and a latitudinal edge 14*b*, wherein the longitudinal edge is attached to the support backing 12. The convex surface of the rigid cap projects outwardly from the longitudinal edge 14*a* and is attached to the support backing 12 to define a cavity for receiving the blades of the shears. In addition, a tool hook 24 is attached to the support frame 42 and spaced below the rigid cap 14 for supporting and securing the lopping shears 15. The tool hook is substantially L-shaped in cross-section including a shorter horizontal leg 28 projecting from the support backing and a longer vertical leg 26 extending upwardly from the shorter horizontal leg and spaced from the support backing. The shorter horizontal leg, the longer vertical leg and the support backing define a recess between the tool hook 24 and the support backing 12 for receiving the pivot 18 of the cutting implement. Preferably, the tool holder also includes a pouch 40 attached to the support backing 12 for storing various other types of cutting implements.

14 Claims, 3 Drawing Sheets

TOOL HOLDER FOR STORING PRUNING AND CUTTING IMPLEMENTS

This application is a continuation application based on prior application Ser. No. 08/171,650, filed on Dec. 22, 1993 now abandoned.

FIELD OF THE INVENTION

This invention generally relates to a tool holder suspended from a waist belt for storing various types of pruning and cutting implements, including lopping shears.

BACKGROUND OF THE INVENTION

Pruning and cutting implements are used extensively in orchards and vineyards for pruning and shaping vegetation both before and during the growing season. Pruning implements are often large, awkward tools having dangerously sharp and pointed blades for cutting through thick vegetation. For example, lopping shears, which are frequently used to prune grapevines, have a pair of sharp blades that curve upwardly to form a point. The blades are attached by a pivot to a pair of elongated handles. Laborers must carry these large, awkward shears with them throughout the vineyard. In fact, laborers often sling these shears over one shoulder in order to carry them. However, the sharp, pointed blades of the shears pose a potential danger to the laborer when carried in this manner or by hand. Laborers cannot even carry the lopping shears in conventional tool holders because the tool holders are not equipped to accommodate such implements. These conventional tool holders are merely carrying and storage devices for tools like hammers and hatchets, which have a single elongated handle and a transversely mounted head piece. These devices generally comprise a tool carrying loop or collar attached to a leather pad suspended from a waist belt. In some cases, the tool carrying loop or collar is hinged or mechanical for facilitating quick storage and release of the hammer. Examples of such devices can be found in U.S. Pat. Nos. 4,790,461; 4,106,679; and 4,372,468. The tool carrying loops and collars of these conventional tool holders cannot safely carry and support cutting and pruning implements, such as lopping shears, which have a dangerously sharp and pointed headpiece pivotally attached to a pair of elongated handles. They do not provide the laborer with any means of protection from the sharp and pointed headpiece of the cutting or pruning implement, nor do they provide the laborer with any means of readily securing an implement which has more than a single shaft for a handle.

In addition to lopping shears, laborers often carry small hand-held pruners for trimming vegetation. It is awkward for the laborer to carry both the lopping shears and the small pruners by hand. The laborer will often leave one implement on the ground while using the other to prune. Consequently, the laborer may step on that implement or leave it behind. Therefore, a tool holder is required that can accommodate simultaneously both a large pruning implement and a small hand-held pruning implement.

The present invention provides a tool holder that may be adapted to suspend from a waist belt and that is used for carrying a large cutting or pruning implement, such as a pair of lopping shears, in such a manner as to secure the implement within the tool holder and protect the wearer from injuring himself or herself with the sharp and pointed headpiece of the implement. In addition, a pouch may be attached to the tool holder of the present invention for carrying additional small hand-held cutting or pruning implements.

SUMMARY OF THE INVENTION

In accordance with the present invention, an apparatus is provided for carrying a cutting implement having a plurality of blades attached by a pivot to a pair of elongated handles. The apparatus includes a support backing, wherein the support backing includes a plurality of vertically extending slots. A waist belt may be passed through the vertically extending slots so that the apparatus may be suspended from the waist belt. A rigid cap is fastened to the support backing for housing the blades of the cutting implement. The rigid cap comprises a convex surface having a latitudinal edge and a longitudinal edge, wherein the longitudinal edge is attached to the support backing. The convex surface of the rigid cap projects outwardly from the longitudinal edge attached to the support backing. Consequently, the latitudinal edge of the rigid cap and the support backing define an opening for receiving the blades of the cutting implement.

In addition, a tool hook is attached to the support backing below the rigid cap for supporting and securing the cutting implement. The tool hook is substantially L-shaped in cross-section defining a horizontal leg and a vertical leg. The horizontal leg is attached to and projects outwardly from the support backing. The vertical leg extends upwardly from the shorter horizontal leg. The horizontal leg, the vertical leg and the support backing define a recess between the tool hook and the support backing for receiving the blades and the pivot of the cutting implement. Finally, the preferred embodiment of the invention also includes a pouch attached to the support backing for storing various types of cutting implements.

Alternative embodiments may include a support backing integrally formed with a waist belt. A support frame may also be attached to the support backing. In this case, the rigid cap and the tool hook are attached to the support frame.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
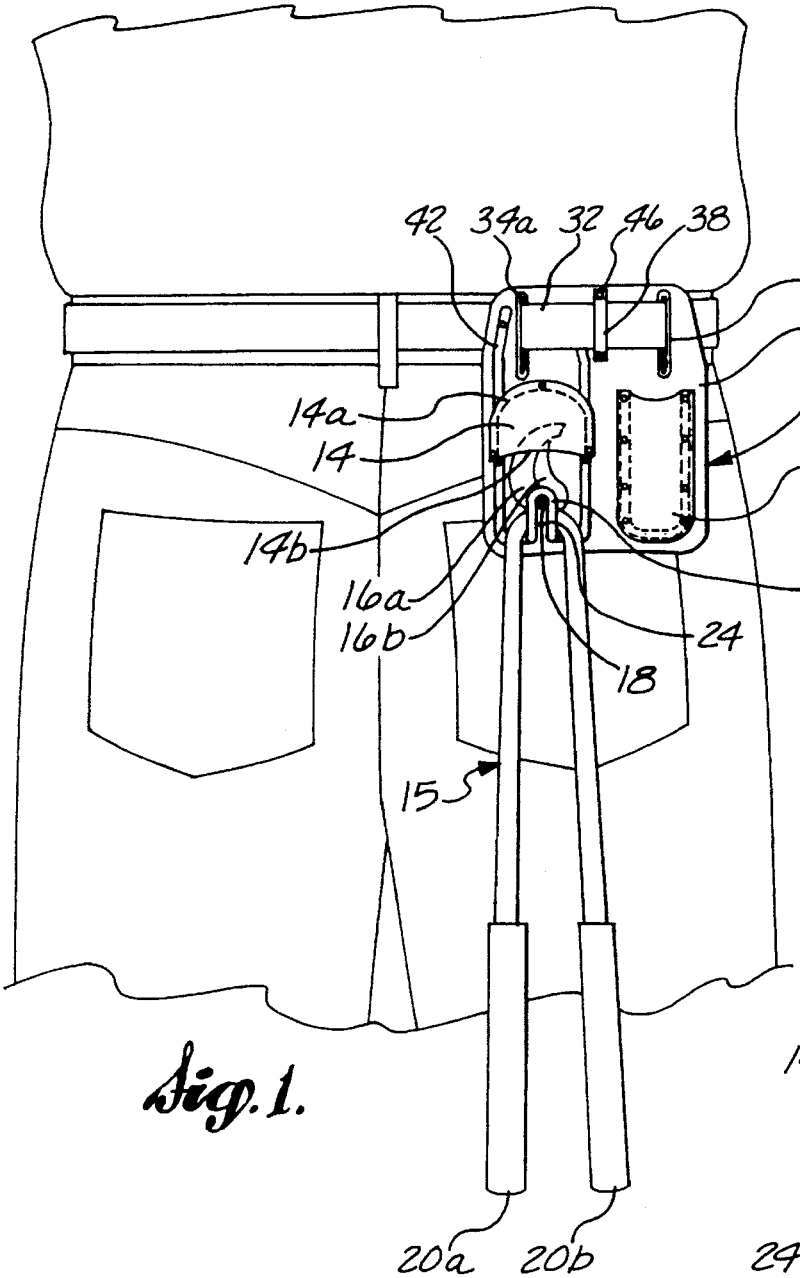
FIG. 1 is a front view of one embodiment of a tool holder made in accordance with the principles of the present invention, wherein the tool holder is suspended from a wearer's waist belt and a pair of lopping shears is stored and secured within the tool holder.

A front view of a preferred embodiment of the present invention in use is shown in FIG. 1. A tool holder 10 is suspended from a wearer's waist belt and supports a pair of lopping shears 15. The lopping shears 15 are typical of the type of shears used by workers in orchards and vineyard to prune vegetation. The lopping shears 15 comprise a pair of sharp pointed blades 16*a* and 16*b* attached by a pivot 18 to a pair of elongated handles 20*a* and 20*b*. The tool holder 10 is formed from a planar support backing 12 preferably made of pliant leather. The support backing further includes a pair of vertically extending slots 34*a* and 34*b* formed in and extending through the upper portion of the support backing. In addition, a belt loop 38 is attached to the support backing 12 approximately midway between the vertically extending slots 34*a* and 34*b*. The belt loop is fastened to the support backing by a number of rivets 46 or a similar fastening means, such as sewing. A waist belt 32 is threaded through the vertically extending slots 34*a* and 34*b*, and the belt loop 38, and thus supports the tool holder 10. The support backing may also include a plurality of loops attached to the support backing through which a waist belt passes in order to suspend the tool holder from the waist belt. A substantially U-shaped frame 42 is vertically attached to the support backing 12 by a number of rivets 46, or similar fastening means. The U-shaped frame has an upper portion 48, a central portion 50 and a lower portion 52.

Figure 2:
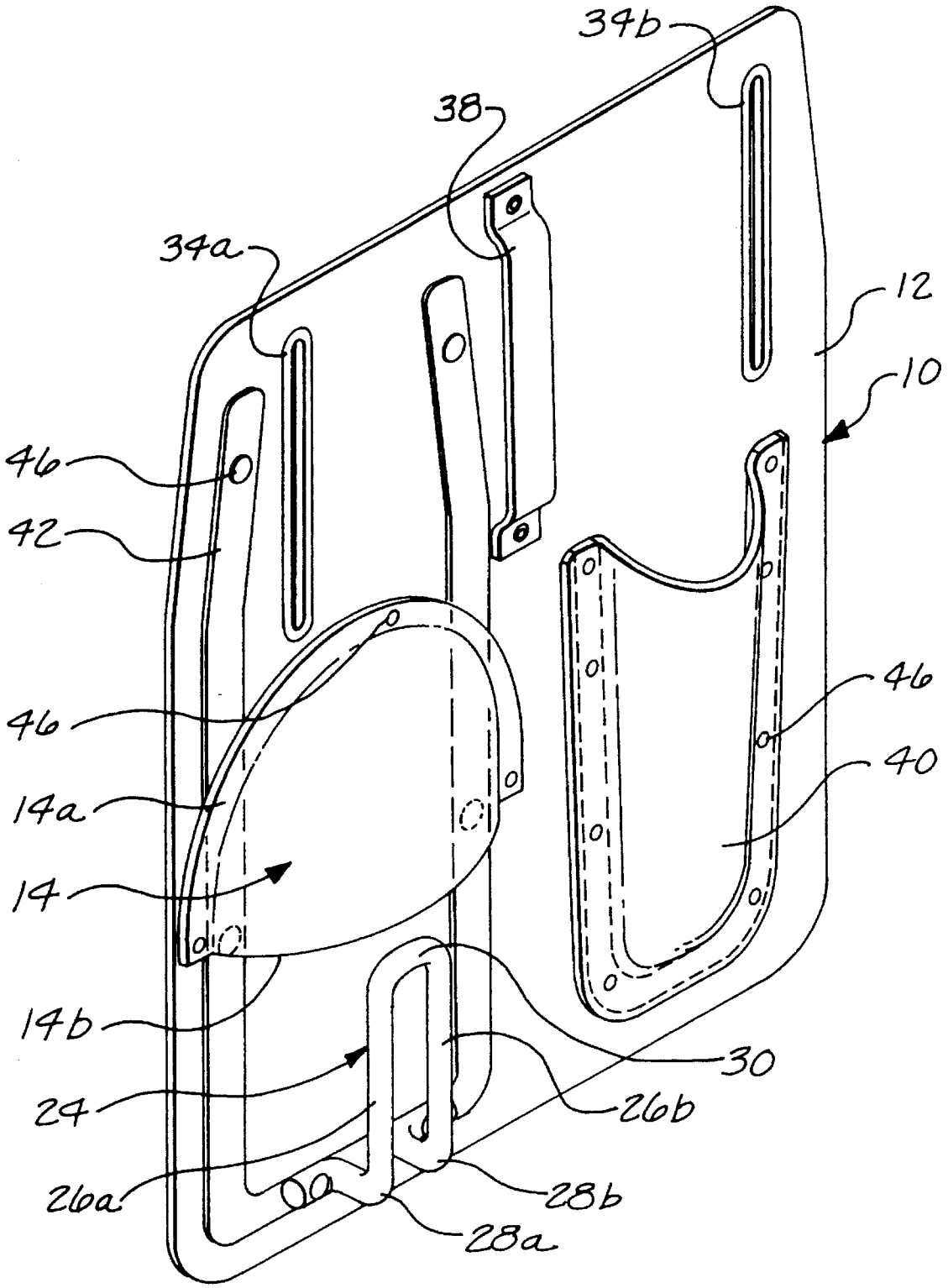
FIG. 2 is a perspective view of the tool holder of FIG. 1.
Figure 3:
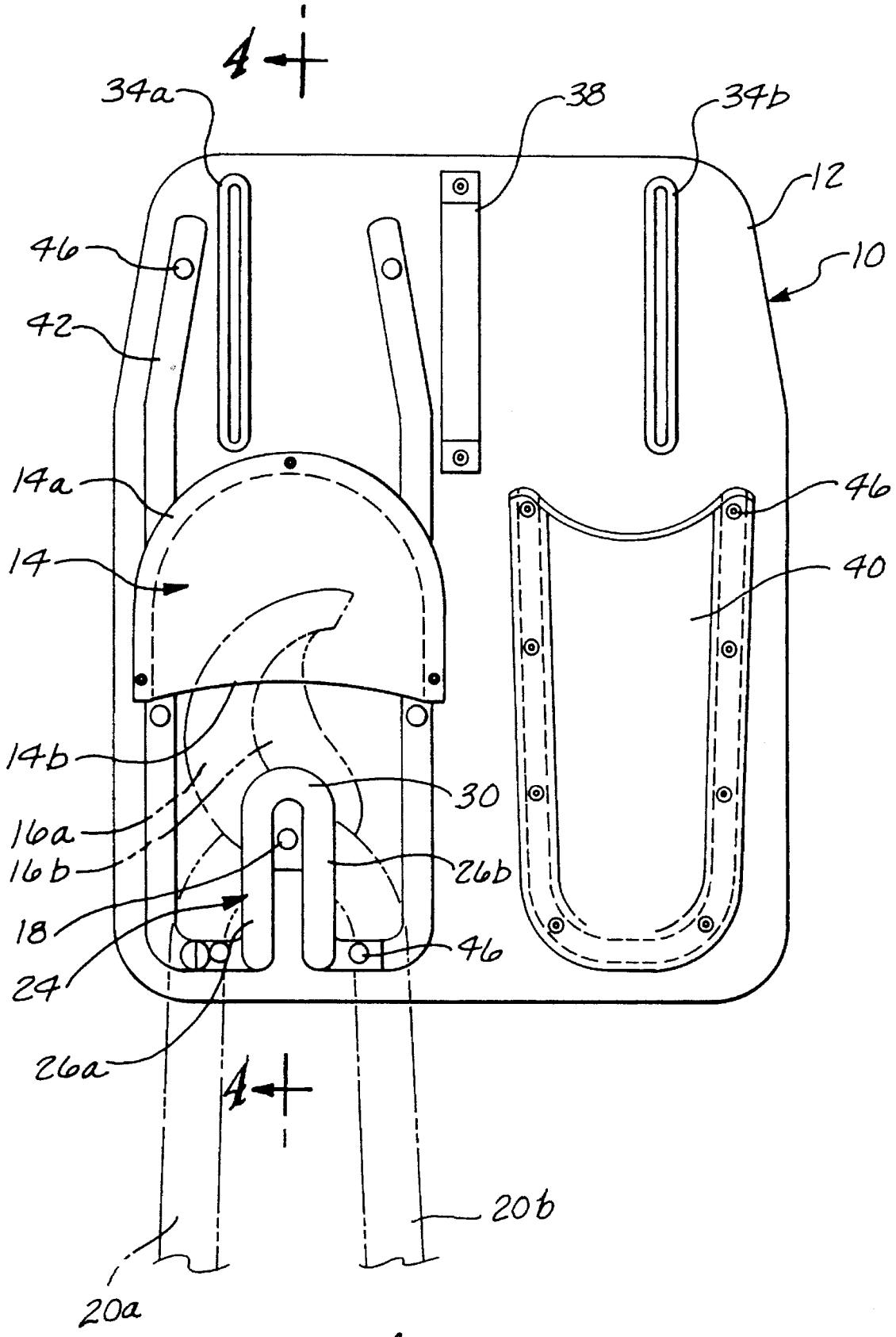
FIG. 3 is a front view of the tool holder of FIG. 2 when storing and securing a pair of lopping shears.

As shown in FIGS. 2 and 3, the tool holder 10 further comprises a rigid cap 14 and a tool hook 24. The rigid cap 14 extends over the sharp pointed blades 16*a* and 16*b* of the lopping shears 15, when the shears are supported by the tool hook 24. The rigid cap 14 comprises a substantially convex surface having a longitudinal edge 14*a* and a latitudinal edge 14*b*. The longitudinal edge of the rigid cap can either be sewn to the support backing or the support backing adjacent and overlapping the central portion 50 of the U-shaped frame 42 by a number of rivets 46, or similar fastening means. As shown in the cross-sectional side view of the tool holder in FIG. 4, the substantially convex surface of the rigid cap projects outwardly from the longitudinal edge 14*a* attached to the support backing 12, thus defining an opening between the latitudinal edge 14*b* of the convex surface and the support backing 12 for receiving the blades 16*a* and 16*b* of the lopping shears 15. The rigid cap 14 is preferably made of a resilient plastic material, but it may also be made of metal or leather materials.

Figure 4:
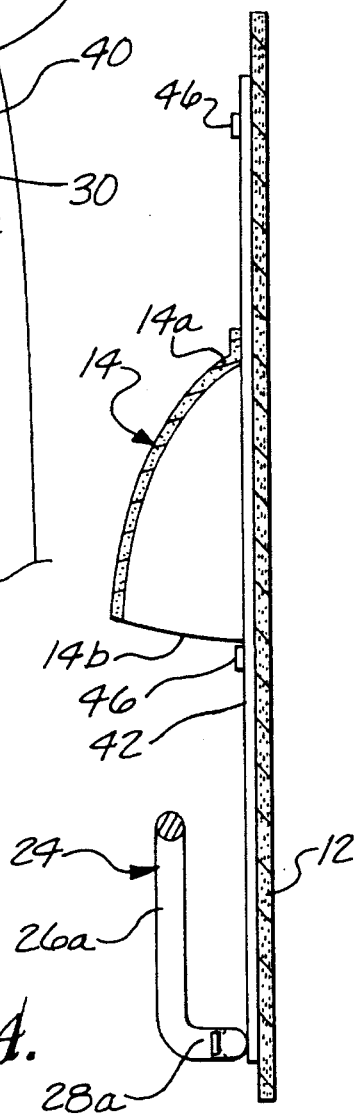
FIG. 4 is a cross-sectional side view of the tool holder of FIG. 2 taken along the lines 4—4 of FIG. 3.

As also shown in FIG. 4, the tool hook 24 is attached to the lower portion 52 of the U-shaped frame directly below the rigid cap 14. The tool hook is substantially L-shaped in cross-section, defining longer vertical legs 26*a* and 26*b* and shorter horizontal legs 28*a* and 28*b*. The shorter horizontal legs are perpendicularly attached to the support frame 42 by rivets 46, or similar fastening means. The longer vertical legs 26*a* and 26*b* extend upwardly from the shorter horizontal legs 28*a* and 28*b* and are parallel to the support backing 12. Consequently, the longer vertical legs of the tool hook, the shorter horizontal legs and the support backing define a recess between the tool hook 24 and the support backing 12. As shown in FIGS. 2 and 3, the upper portions of the vertical legs 28*a* and 28*b* are actually connected by a horizontal bar 30. The tool hook 24 is attached to the U-shaped frame 42 so that the latitudinal edge 14*b* of the rigid cap 14 is spaced from horizontal bar 30 a sufficient distance so as to mount the lopping shears on the tool hook while retaining the points of the shear blades within the cap 14.

In order to store the lopping shears 15 in the tool holder 10, the wearer passes the blades 16 of the lopping shears through the opening defined between the latitudinal edge 14*b* of the rigid cap 14 and the support backing 12, until the blades 16*a* and 16*b* make contact with the uppermost portion of the rigid cap. The wearer then passes the pivot 18 of the shears over the horizontal bar 30 of the tool hook 24 and moves the shears inwardly, through the space between the latitudinal edge of the rigid cap and the horizontal bar. Finally, the wearer allows the pivot 18 to fall into the recess defined by the tool hook 24 and the support backing 12, which allows the pivot 18 to rest on the tool hook 24 so that the tool hook supports the weight of the shears. In particular, the tool hook 24 passes between the elongated handles 20*a* and 20*b* and the upper portions of the elongated handles 20*a* and 20*b* rest upon the shorter legs 28*a* and 28*b* of the tool hook. Once in this position, the sharp pointed blades 16*a* and 16*b* are housed within the rigid cap 14, so that the wearer is protected from making contact with the sharp pointed blades. In addition, the tool hook 24 secures the lopping shears 15 in a stationary position between the vertical legs 26*a* and 26*b* of the hook and the support backing 12. Thus, the vertical legs of the tool hook prohibit any lateral movement of the lopping shears that could potentially cause an injury to the wearer.

To remove the lopping shears 15, the wearer lifts the lopping shears upwardly so that the upper portion of the blades 16*a* and 16*b* make contact with the uppermost inner portion of the rigid cap 14. The wearer can then pass the pivot 18 over the horizontal bar 30 of the tool hook 24 and swing the shears outwardly through the space between the latitudinal edge 14*b* of the rigid cap 14 and the horizontal bar 30 until the pivot 18 clears the tool hook 24. Finally, the wearer slides the blades 16*a* and 16*b* downwardly through the opening between the latitudinal edge 14*b* and the support backing 12, thus removing the lopping shears 15 from the tool holder 10.

In addition to storing and securing large cutting and pruning implements such as lopping shears, the tool holder 10 is equipped with a pouch 40 for storing various other types of implements such as knives or scissors. The pouch 40 is substantially U-shaped and can be sewn directly to the support backing 12 or attached to the support backing by a number of rivets 46, or similar fastening means. The pouch has an open upper end for receiving implements passed into the pouch. Preferably, the pouch is made of a rigid material such as plastic or leather.

While a preferred embodiment of the invention has been illustrated and described, it will be appreciated that various changes can be made to the illustrated embodiment without departing from the spirit and scope of the invention. For example, although the illustrated embodiment is designed to most efficiently receive the lopping shears pictured, the dimensions can be altered to accept other shears of varying dimensions. The tool holder may be equipped to receive shears such as hedge clippers, which have elongated blades. In order to receive such shears, the rigid cap 14 would be elongated and spaced higher above the tool hook 24. Accordingly, it is not intended that the scope of the invention be limited by the disclosure of the preferred embodiment; instead, the invention should be determined entirely by reference to the claims that follow.

The embodiments of the invention in which an exclusive property or privilege is claimed are defined as follows:

1. An apparatus for carrying a cutting implement having a plurality of blades attached by a pivot to a pair of elongated handles, comprising:

(a) a support backing;

(b) a support frame attached to the support backing:

(c) a rigid cap attached to the support backing adjacent to the support frame for housing the blades of the cutting implement; and (d) a tool hook attached to the support frame and spaced below the rigid cap a sufficient distance such that when the cutting implement is mounted on the tool hook, the tool hook cooperates with the rigid cap and the support frame to support and secure the pivot and blades of the cutting implement against the support backing and beneath the rigid cap.

2. The apparatus of claim 1, wherein the support backing has a plurality of vertically extending slots formed therefor through which a waist belt passes, so that the apparatus may be suspended from the waist belt.

3. The apparatus of claim 1, further comprising at least one loop fastened to the support backing and through which the waist belt passes, so that the apparatus may be suspended from the waist belt.

4. The apparatus of claim 1, wherein the support frame includes an upper portion, a central portion, and a lower portion.

5. The apparatus of claim 4, wherein the rigid cap is attached adjacent to the central portion of the support frame, and wherein the tool hook is attached to the lower portion of the support frame.

6. The apparatus of claim 4, wherein the tool hook is attached to the lower portion of the support frame.

7. The apparatus of claim 1, wherein the rigid cap comprises a convex surface having a latitudinal edge and a longitudinal edge, wherein the longitudinal edge is attached to the support backing, wherein the convex surface projects outwardly from longitudinal edge attached to the support backing, and wherein the latitudinal edge and the support backing define an opening for receiving the blades of the cutting implement.

8. The apparatus of claim 1, further comprising a pouch attached to the support backing for storing implements.

9. The apparatus of claim 8, wherein the pouch is substantially U-shaped, and wherein the pouch has an open upper end for receiving implements passed into the pouch.

10. An apparatus for storing a cutting implement having a plurality of blades pivotally attached to a pair of elongated handles, comprising:

(a) a support backing;

(b) a securing means attached to the support backing for storing and securing the cutting implement comprising:

(i) a support frame having a central portion and a lower portion; and (ii) a tool hook attached to the lower portion of the support frame, wherein the tool hook cooperates with the support frame to support and secure the pivot and blades of the cutting implement against the support backing when the cutting implement is mounted on the tool hook;. and (c) a housing means fastened to the support backing, wherein the housing means cooperates with the securing means to house the blades of the cutting implement; and (d) a storing means attached to the support backing having an open, upper end for receiving various types of implements to be stored within said storing means.

11. The apparatus of claim 10, further comprises a suspending means wherein the support backing includes a plurality of vertically extending slots through which a waist belt passes, so that the apparatus may be suspended from the waist belt.

12. The apparatus of claim 11, wherein the suspending means further comprises a loop attached to the support backing and through which the waist belt passes, so that the apparatus may be suspended from the waist belt.

13. The apparatus of claim 11, wherein the suspending means further comprises a plurality of loops attached to the support backing and through which the waist belt passes, so that the apparatus may be suspended from the waist belt.

14. The apparatus of claim 10, wherein the housing means comprises a rigid cap, and wherein the rigid cap further comprises a convex surface having a longitudinal edge and a latitudinal edge, wherein the longitudinal edge is attached to the support backing and the central portion of the support frame, wherein the convex surface projects outwardly from the longitudinal edge attached to the support backing, and wherein the latitudinal edge and the support backing define an opening between the convex surface and the support backing for receiving the blades of the cutting implement.

* * * * *